US009580293B2

(12) United States Patent
Birtcher et al.

(10) Patent No.: US 9,580,293 B2
(45) Date of Patent: Feb. 28, 2017

(54) DIPTUBE DESIGN FOR A HOST AMPOULE

(71) Applicant: AIR PRODUCTS AND CHEMICALS, INC., Allentown, PA (US)

(72) Inventors: Charles Michael Birtcher, Valley Center, CA (US); Gildardo Vivanco, San Diego, CA (US); William Jon Sheehy, Valley Center, CA (US)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 5 days.

(21) Appl. No.: 14/744,133

(22) Filed: Jun. 19, 2015

(65) Prior Publication Data

US 2015/0368087 A1 Dec. 24, 2015

Related U.S. Application Data

(60) Provisional application No. 62/016,367, filed on Jun. 24, 2014.

(51) Int. Cl.
*B67D 7/02* (2010.01)

(52) U.S. Cl.
CPC ..... *B67D 7/0288* (2013.01); *Y10T 29/49828* (2015.01)

(58) Field of Classification Search
CPC ..... B67D 7/0288; Y10T 29/49828
USPC ..... 222/464.1
See application file for complete search history.

(56) References Cited

U.S. PATENT DOCUMENTS

| | | | | |
|---|---|---|---|---|
| 3,371,822 | A * | 3/1968 | Galloway | A23G 9/045 220/86.1 |
| 4,440,319 | A | 4/1984 | Nitchman et al. | |
| 4,531,656 | A | 7/1985 | Nitchman et al. | |
| 5,069,243 | A | 12/1991 | Foreman | |
| 5,199,603 | A | 4/1993 | Prescott | |
| 5,562,132 | A * | 10/1996 | Siegele | B01J 4/00 137/209 |
| 5,663,503 | A | 9/1997 | Dam et al. | |
| 5,782,381 | A | 7/1998 | Woodruff et al. | |
| 5,988,456 | A * | 11/1999 | Laible | B67D 7/0294 222/464.1 |
| 6,077,356 | A | 6/2000 | Bouchard et al. | |
| 7,124,913 | B2 | 10/2006 | Birtcher et al. | |
| 2004/0262327 | A1 * | 12/2004 | Birtcher | B67D 7/0272 222/64 |

FOREIGN PATENT DOCUMENTS

| | | |
|---|---|---|
| JP | H07024751 | 5/1995 |
| KR | 200427901 | 10/2006 |

* cited by examiner

*Primary Examiner* — Donnell Long
(74) *Attorney, Agent, or Firm* — Lina Yang

(57) ABSTRACT

In one respect, the invention is an improved diptube design for a container for containing and dispensing a liquid chemical, the diptube generating a spring force when compressed that acts to maintain a bottom end of the diptube in contact with a bottom interior surface of the container and a notch located at a bottom edge of the bottom end of the diptube that creates a flow communication between the diptube and the interior volume of the base portion of the container. In another respect, the invention is a method of constructing a container having these limitations.

19 Claims, 5 Drawing Sheets

DIPTUBE DESIGN FOR A HOST AMPOULE

CROSS-REFERENCE TO RELATED APPLICATIONS

This application claims priority to and benefit of U.S. Provisional Ser. No. 62/016,367, filed Jun. 24, 2014, which is incorporated herein by reference in its entirety.

BACKGROUND OF THE INVENTION

The electronic device fabrication industry requires various liquid chemicals as raw materials or precursors to fabricate integrated circuits, wafers, and other electronic devices. The purity of the chemicals that are used in these applications must be very high in order to meet the stringent requirements of the electronic fabrication industry.

A portion of the efforts used to provide high purity chemicals goes into the design and structure of the containers and systems which deliver these chemicals to the reactor or furnaces where the electronic devices are being fabricated. The purity of the chemicals can deteriorate over time due to thermal decomposition, physical agitation, or chemical reaction with oxygen, moisture, or other contaminants located within the system. It is therefore desirable to periodically in-situ clean the chemical containers with cleaning agent or solvent and a purge gas. However, the solvent itself can serve as a contaminant during the fabrication process if not removed completely from the chemical container before processing chemicals are reintroduced. Therefore, it is desirable to evacuate as much of the solvent as possible from the chemical container after the cleaning process.

In addition, it is important to monitor the quantity of high purity chemical available in the container during its use in the electronic device fabrication process to ensure that enough chemical is available for batch processing and/or fabrication of the wafers. Because the high purity chemicals used in the fabrication process are very expensive, it is desirable to consume as much of the chemical as possible prior to conducting a cleaning cycle. However, it is also important to not empty the chemical container completely, because without leaving any residual chemical (i.e., heals) in the container, the electronic device fabrication process can operate in a run-dry condition, which can result in wafer defects and costly reductions in product yields. Therefore, careful monitoring of the quantity of remaining chemical in the chemical container is desirable.

Various attempts have been made in the prior art to address the issues of purity and monitoring of the quantity of chemicals available for use in chemical containers.

Some known prior art references disclose chemical containers comprising inlet and outlet valves and a diptube, but do not teach a level sensor probe or any means to measure the quantity of chemical remaining in the container.

Another known prior art reference discloses a chemical container with a diptube and an internal float level sensor.

Another known prior art reference discloses a chemical container with a rounded floor and a diptube.

Yet another known prior art reference discloses a chemical container with inlet and outlet valves, a diptube comprising a bend, and a chemical level sensor probe, but in this reference the base portion of the container has a rounded floor and the diptube does not make contact with the floor of the base portion.

There is a need to address the shortcomings of the prior art in addressing the goals of chemical purity, chemical quantity monitoring, and efficient chemical utilization.

BRIEF DESCRIPTION OF SEVERAL VIEWS OF THE DRAWINGS

The present invention will hereinafter be described in conjunction with the appended drawing figures wherein like numerals denote like elements.

DETAILED DESCRIPTION OF THE INVENTION

Figure 2:
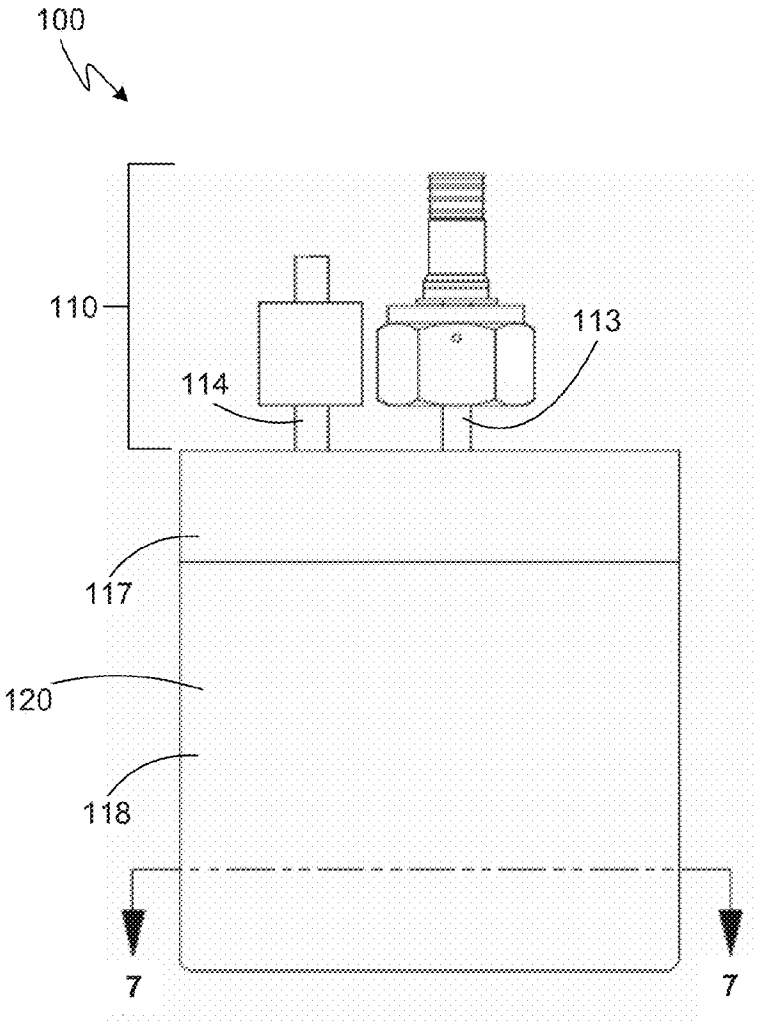
FIG. 2 is a right side view thereof shown along line 2-2 of FIG. 1.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. Various changes may be made in the function and arrangement of elements without departing from the spirit and scope of the invention, as set forth in the appended claims.

For purposes of the present specification and the appended claims, a "bend" is defined as a tubular member having at least one non-infinite radius of curvature. Preferably, the radius of curvature of the bend is less than 1000 cm.

For purposes of the present specification and the appended claims, two lines, surfaces, planes, parts, components, or assemblies are considered to be "substantially parallel" to another when an absolute value of the measurement of the angle between the two lines, surfaces, planes, parts, components, or assemblies does not exceed 10 degrees.

For purposes of the present specification and the appended claims, the term "flow communication" refers to the nature of connectivity between two or more parts or components that enables liquids, vapors, and/or gases to be transported between the parts or components in a controlled fashion (i.e., without leakage). Coupling together two or more parts or components such that they are in flow communication with each other can involve any suitable method known in the art, such as by the use of welds, flanged conduits, gaskets, fasteners, and adhesives. Two or more parts or components may also be coupled together in "flow communication" via intermediate components of the system that may physically separate them.

Generally, a host ampoule (container) for use in the electronic device fabrication industry is formed with a lower, base portion and an upper lid. A diptube is generally first fixedly attached to the underside of the lid, for example by welding. Then, the container is fully constructed by placing the lid and joined diptube atop the base portion and fixedly attaching the lid to the base portion, for example via a perimetral weld or via a plurality of bolts, clamps, or other fasteners. In welded applications, due to shrinkage that will inevitably occur in the weld, it is difficult to size a straight diptube properly such that it is long enough to reach the bottommost portions of the container after the weld shrinkage has occurred in an orientation that both maximizes its ability to drain and fill the container, as appropriate, and short enough that it does not fully seal itself against the interior bottom surface of the container such that it can no longer function.

Additionally, because in some applications it is desirable to have the bottom end of a diptube centrally located within the container, and owing to the fact that existing diptubes are straight, the diptube generally takes up a substantial portion of the central volume of the container (i.e., the volume located approximately along the centerline of the height of the container). This central volume of the container is therefore not free to receive other components of the system, for example a fluid level sensor probe.

In some embodiments according to the present invention, the "central volume" of the container comprises the cylindrically-shaped volume of the container that is measured along the height of the container centered about the centerline thereof, the central volume having a radius that is measured orthogonally from the centerline. In additional embodiments according to the present invention, the central volume of the container has a radius with a value that is at least 5% but no greater than 75% of the value of the radius of the container. In additional embodiments according to the present invention, the central volume of the container has a radius with a value that is at least 5% but no greater than 50% of the value of the radius of the container. In additional embodiments according to the present invention, the central volume of the container has a radius with a value that is approximately 5%-30% of the value of the radius of the container.

The present invention provides an improved diptube design for a host ampoule (container) that facilitates the refill, waste recovery, and cleaning processes of all wetted surfaces via a single line between the container and a connected refill/recovery system. The diptube is of full-length design and will reach the bottommost portions of the container, thereby allowing the entire contents of the container to be pushed out when the diptube is used as a drain in a first mode of operation of the system. The diptube can also be used to deliver cleaning solution to the bottommost portions of the container in the second mode of operation of the system. In this second mode of operation, a second line is connected at its first end to the headspace of the container (e.g., via port 115) and at its second end to a waste recovery container. The cleaning agent or solvent can thus be pushed into the container via the diptube, thereby filling the container, and then the used cleaning agent or solvent solution can be pushed out through the second line into the connected waste recovery container. The diptube design according to the present invention reduces the required cleaning time and the quantity of solvent and purge gas needed during the cleaning process.

Like existing systems, the diptube according to the present invention is first fixedly attached, e.g., welded, to the lid of the container before the lid is fixedly attached—e.g., welded, clamped, or bolted—to the base portion. However, unlike existing systems, the diptube of the present invention is shaped with a bend and the diptube is sized such that the lid and joined diptube need to be pressed down while atop the container bottom to fixedly attach the lid to the container bottom. The bend located in the diptube generates an inherent mechanical spring effect in the diptube when it is compressed that maintains the bottom edge of the diptube in perimetral contact with the interior bottom surface of the container, even in embodiments where weld shrinkage between the lid and base portion has caused the diptube to become further compressed within the container. The bend, furthermore, orients the bottom end of the diptube such that it remains perimetrally sealed with the interior bottom surface of the container, despite the weld shrinkage.

Further, in some embodiments according to the present invention, the bend in the diptube places the top end of the diptube such that it is welded to an off-center port which is not aligned along the centerline of the container. In these embodiments, this off-center placement of the diptube permits the central volume of the container to remain free in order to receive a level sensor probe for measuring the chemical level remaining in the container. In some embodiments according to the present invention, the container has a planar (flat) portion of the interior bottom surface of the container which represents the lowermost interior surface of the container, and to which both the diptube and level sensor probe extend. In some embodiments, the planar portion is located within the central volume of the container. In alternate embodiments, the planar portion could be located anywhere within the volume of the container, for example offset from a centerline of the container all the way out to an outer perimetral wall of the container. By permitting the level sensor probe to extend all the way down to this planar portion, the level sensor probe can provide the most accurate possible measurements of the chemical level remaining in the container.

The bottom end of the diptube is also provided with a pair of notches which oppose another along the perimeter of the bottom edge of the diptube. As noted above, the inherent mechanical spring effect in the diptube forces the bottom edge of the diptube against the interior bottom surface of the container. With the bottom edge perimetrally sealed to the interior bottom surface of the container via the spring constant generated by the diptube, the diptube notches act as drain holes that facilitate headspace pressure to be used in the container to force liquids and solid residue through the diptube and out of the container via the notches to fully drain and dry the container for continued use. While in the present embodiment exactly two notches are provided at the bottom end of the diptube, in alternate embodiments any number of notches could be provided at the bottom end of the diptube that extend through the exterior wall of the diptube into the interior passageway thereof. In further alternate embodiments, the notches could comprise one or more holes, slots or other perforations that are located near the bottom end of the diptube and that extend through the exterior wall of the diptube into the interior passageway thereof.

The combined features of the off-center diptube with inherent spring effect, the container with a concave interior bottom surface, and the level sensor probe located within the central volume of the container allows for the use of a single refill line to both recover chemical waste, cleaning agent or solvent, or purge gas from all wetted surfaces within the container and to dry and refill the container with fresh chemical for the production or fabrication process.

Figure 1:
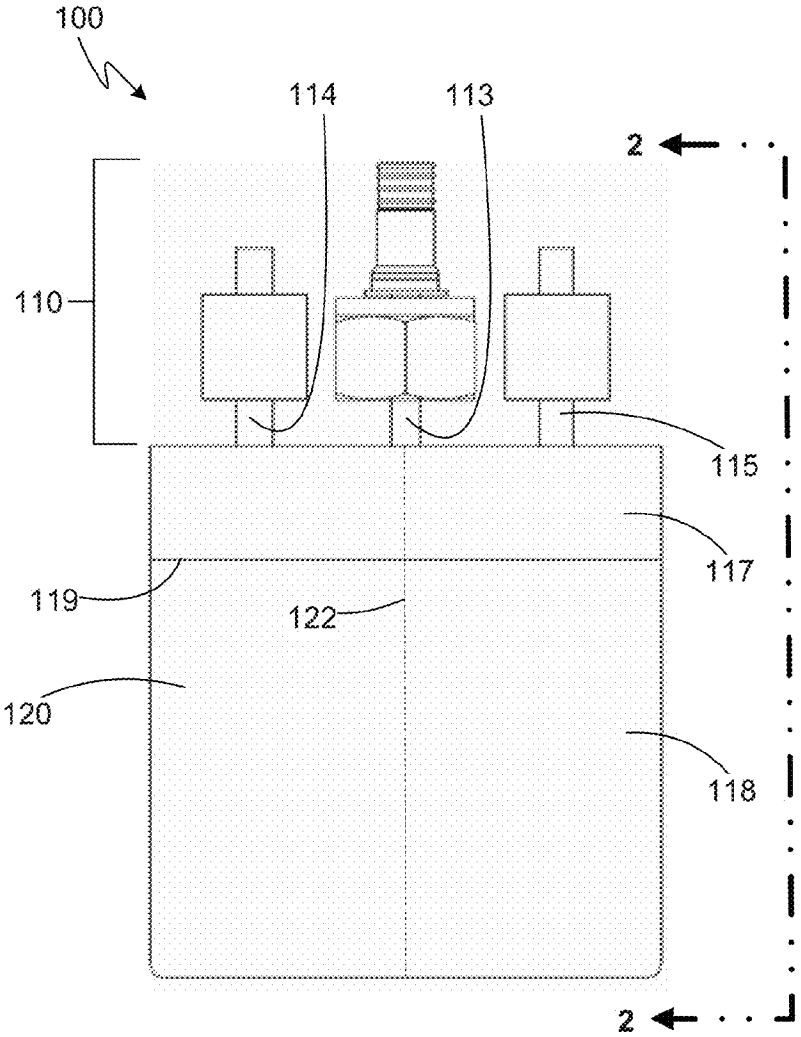
FIG. 1 is a front view of a host ampoule in accordance with a first embodiment of the present invention.
Figure 4:
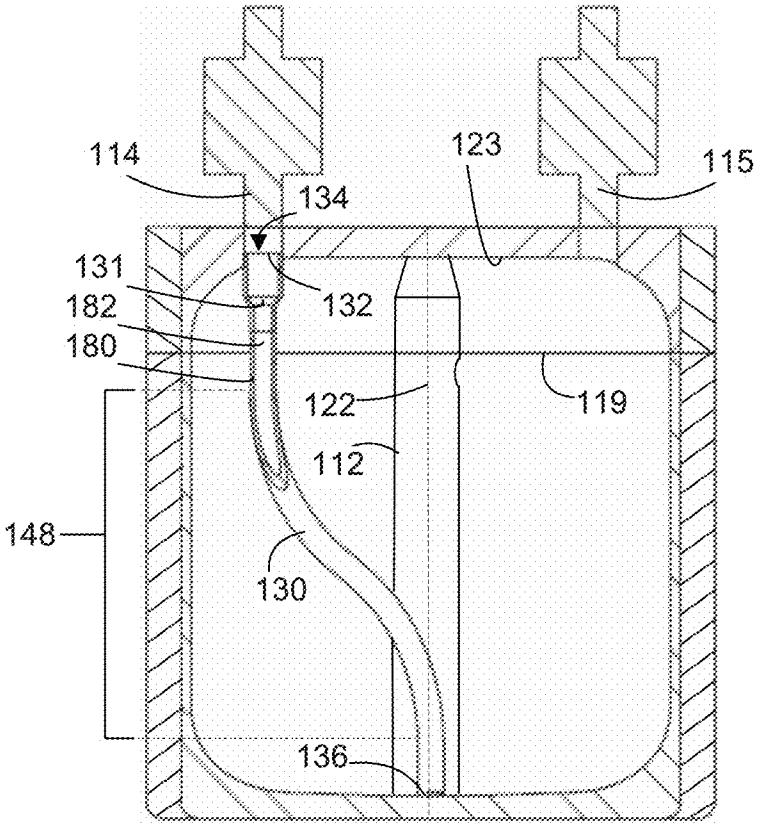
FIG. 4 is a sectional view taken along line 4-4 of FIG. 3.
Figure 3:
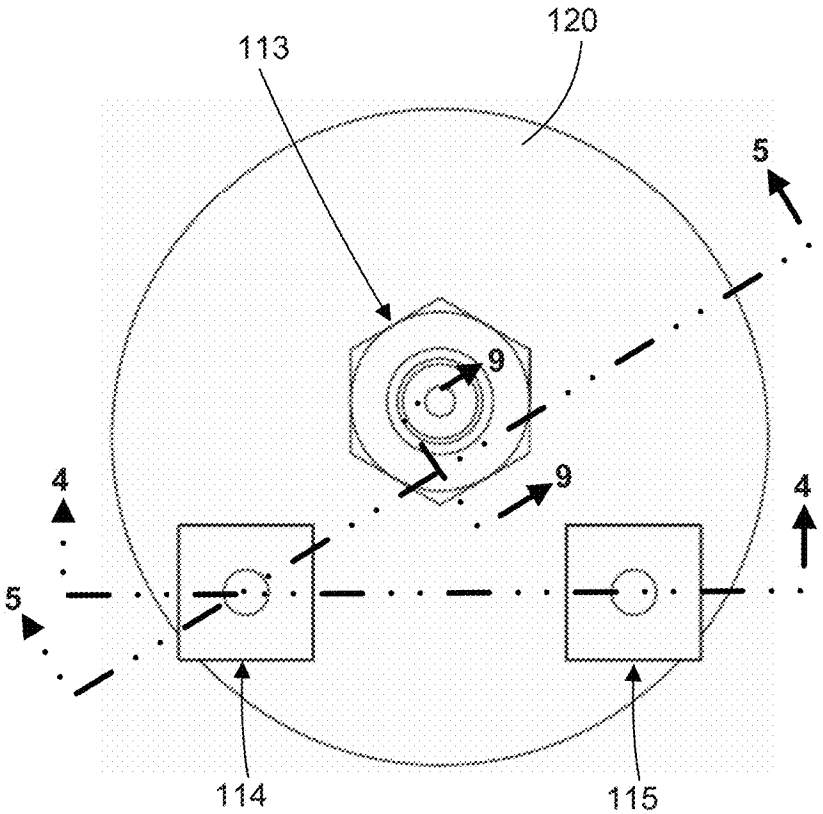
FIG. 3 is a top view thereof.

Referring generally to FIGS. 1-7, 9, and 10, an exemplary embodiment of a system 100 in accordance with the present invention will now be described in detail. In this embodiment, the system 100 comprises a valve/line assembly 110 attached to a host ampoule or container 120. The container has a base portion 118 and a lid 117 that is placed atop the base portion 118 and perimetrally welded thereto, leaving a visible weld 119. As noted above, in alternate embodiments the lid 117 could be fixedly attached to the base portion 118 via other means, for example by a plurality of clamps or bolts located around the perimeters thereof. Referring back to the Figures, in this embodiment the lid 117 has a lower (interior) surface 123 (see FIGS. 4 and 5). FIG. 1 is a front view of the system 100, and FIG. 2 is a right side view thereof shown along line 2-2 of FIG. 1. As shown in FIGS. 1, 3, and 4, ports 114, 115 enter the container 120 at a location away from a centerline 122 of the container 120. Port 114 is welded or otherwise fixedly attached to a top edge 134 of a top end 132 of a diptube 130, which includes a coupling 131 that acts to reduce the diameter of the piping of the port 114 to the diameter of the diptube 130. In this embodiment, the diameter of the piping of the port 114 is 0.375 inches (0.953 centimeters), and the diameter of the diptube 130 is 0.250 inches (0.635 centimeters), thus requiring the coupling 131. In alternate embodiments, the diameters of the piping of the port 114 and the diptube 130 may be equal, thus eliminating the need for the coupling 131. In the present embodiment, the container 120 has an interior bottom surface 124 that is substantially concave and includes a planar portion 126 (see FIG. 7) thereon located about the centerline 122 of the container 120. The exterior walls of the container 120 are defined by an outer perimetral wall 128 (see FIG. 7).

Figure 6:
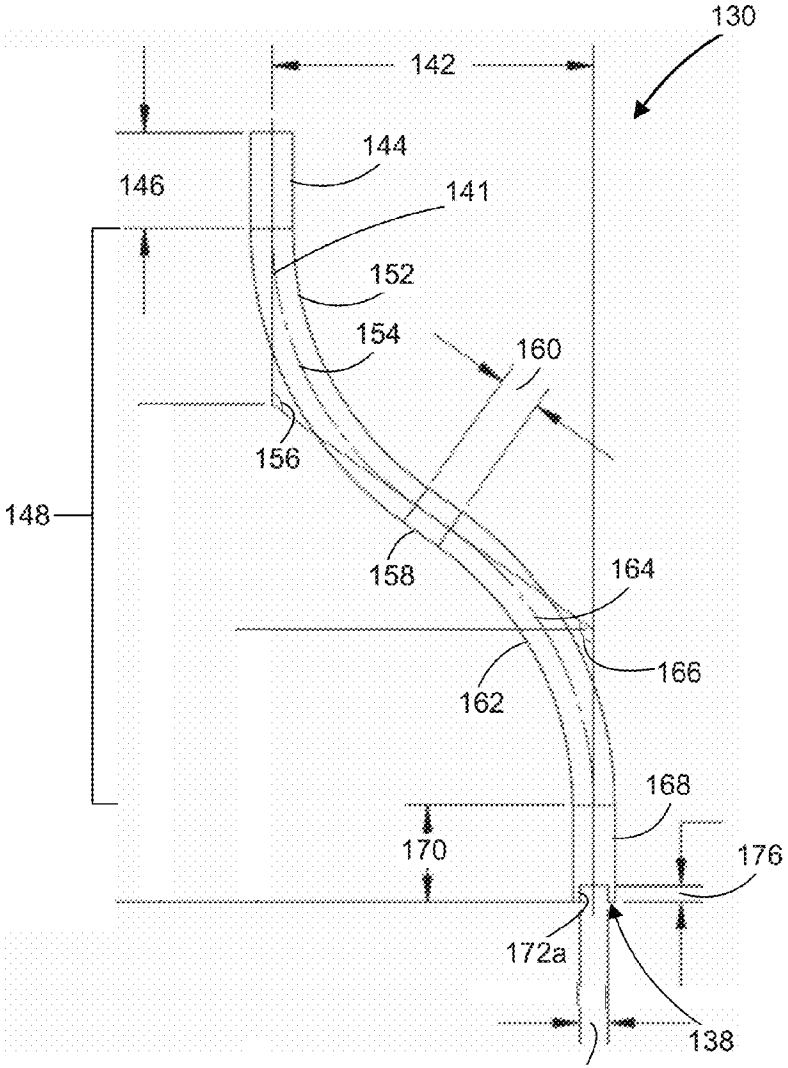
FIG. 6 is a side view of a diptube in accordance with an embodiment of the present invention.
Figure 5:
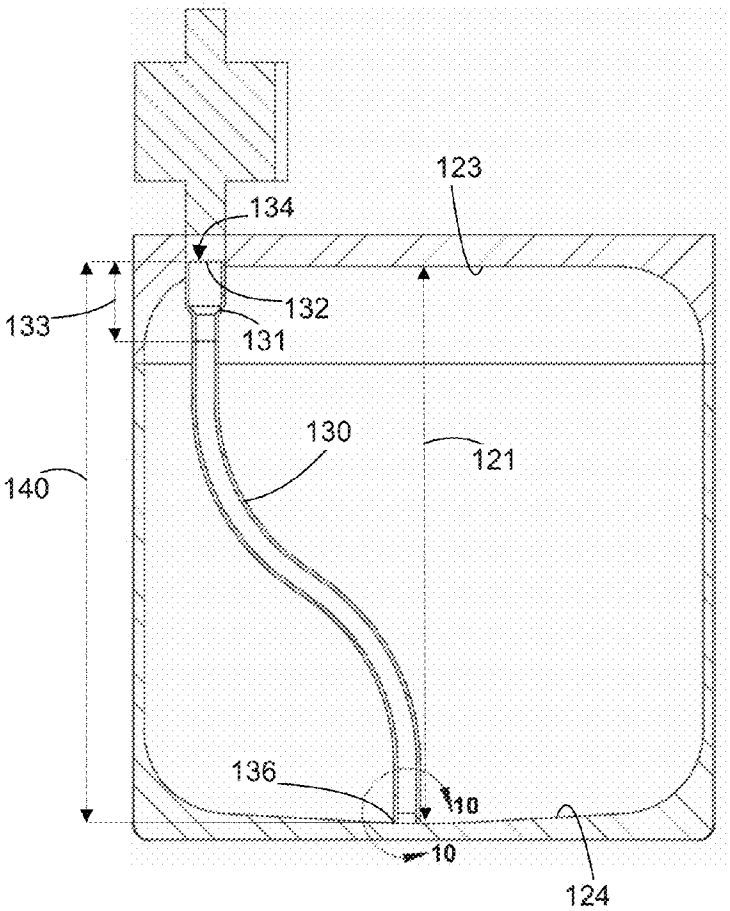
FIG. 5 is a sectional view taken along line 5-5 of FIG. 3.

As shown in FIGS. 4 and 6, in this embodiment the diptube 130 has a bend 148 in it that generates an inherent mechanical spring effect that allows a bottom edge 138, which is located at a bottom end 136 of the diptube 130, to effectively seal with the interior bottom surface 124, and to remain sealed with the interior bottom surface 124 despite any weld shrinkage that may occur at the weld 119 between the lid 117 and the base portion 118 of the container 120. Further, as shown in FIG. 5, by having the diptube 130 connect at its top end 132 to the port 114 away from the central volume of the container 120 (i.e., away from the volume that is approximately along the centerline 122 of the container 120), the central volume is free to receive a level sensor probe 112 that is used to measure the level of chemical (or other liquid) that is remaining in the container 120. The level sensor probe 112 is attached to the lid 117 via a gland 113. Because the level sensor probe 112 can therefore extend all the way down to the lowermost interior surface of the container 120 (i.e., to the planar portion 126 of the interior bottom surface 124), the level sensor probe 112 can provide the most accurate possible measurements of the chemical level remaining in the container 120.

The lowermost interior surface of the container 120 corresponds with the planar portion 126, which in this embodiment is located along the centerline 122 of the container 120. In alternate embodiments, the planar portion 126 could be located anywhere on the interior bottom surface 124 of the container, and need not be along the centerline 122 or within the central volume of the container 120. In alternate embodiments, the planar portion 126 need not be circular and can be any shape with an area that comprises between 0.0001% and 100% of the area of the interior bottom surface 124.

Details of an embodiment of the diptube 130 are shown in FIGS. 5 and 6 in its installed (i.e., compressed) state, with the coupling 131—which has a length 133—omitted from view in FIG. 6. As shown in FIG. 5, in this embodiment the diptube 130 has a height 140 that is measured from the top end of the coupling 131 to the bottom end of the tubular portion of the diptube 130, and this height 140 is slightly greater than the maximum internal height 121 of the container 120, which is measured between the lower surface 123 of the lid 117 and the planar portion 126 of the interior bottom surface 124. The radial centerline of the top end 132 of the diptube 130 is offset from (i.e., is not collinear with) the radial centerline of the bottom end 136 of the diptube 130 by an offset distance 142. In this embodiment, the top edge 134 is parallel with the bottom edge 138.

In alternate embodiments according to the present invention, the top edge 134 is substantially parallel to the bottom edge 138. In further alternate embodiments, the top edge 134 and bottom edge 138 need not be parallel or substantially parallel.

Moving from top end 132 to bottom end 136, the diptube 130 has a top straight portion 144 having a length 146, the bend 148, and a bottom straight portion 168 having a length 170. The bend 148 is comprised of a top curved portion 152 having a length 154, a middle straight portion 158 having a length 160, and a bottom curved portion 162 having a length 164. It should be understood that the lengths 154,164 are measured along the curvature of the respective curved portions 152,162. In this embodiment, the top straight portion 144 is parallel to the bottom straight portion 168, the top straight portion 144 is angled with respect to the middle straight portion 158 by an angle 156, and the bottom straight portion 168 is angled with respect to the middle straight portion 158 by an angle 166. In this embodiment, the values of the angles 156,166 are both 135 degrees. Preferably, the values of the angles 156,166 are in the range of 91-179 degrees. More preferably, the values of the angles 156,166 are in the range of 100-170 degrees. Even more preferably, the values of the angles 156,166 are in the range of 120-150 degrees. Although in the present embodiment the values of the angles 156,166 are equal when the diptube 130 is installed and compressed within the container 120, in alternate embodiments the values of the angles 156,166 need not be equal after installation. Where it is desirable to have the angles 156,166 be equal after installation, it may be necessary to make the initial value of angle 156 slightly greater than the initial value of angle 166, because in this embodiment the top curved portion 152 is more likely to become compressed than the bottom curved portion 162, thus affecting the value of angle 156 more than the value of angle 166.

In this embodiment, the length 141 of the diptube 130 is measured along the curvature thereof, and is equal in value to the sum of the values of the length 133 of the coupling 131, the length 146 of the top straight portion 144, the length 154 of the top curved portion 152, the length 160 of the middle straight portion 158, the length 164 of the bottom curved portion 162, and the length 170 of the bottom straight portion 168. In this embodiment, the length 141 is greater than the height 140 of the diptube 130. Preferably, the value of the length 141 is between 5-30% greater than the value of the height 140 of the diptube 130. More preferably, the value of the length 141 is between 10-20% greater than the value of the height 140 of the diptube 130.

As shown in FIGS. 4, 7, 9, and 10, the diptube 130 comprises an exterior wall 180 and an interior passageway 182 that connects the top end 132 in flow communication with the bottom end 136. In this embodiment, the diptube 130 is tubular and therefore the cross-sectional area of the open portion (i.e., interior passageway 182) of the diptube 130 is circular. In alternate embodiments, the interior passageway 182 of the diptube 130 may have a cross-sectional area that is square, rectangular, triangular, hexagonal, octagonal, or any other suitable regular or irregular geometric shape.

In this embodiment, the diptube 130 is shaped with the bend 148, thus creating the inherent mechanical spring effect via a leaf spring design. In alternate embodiments according to the present invention, the diptube 130 may include more than one bend, or may have a coiled or helical shape with the turns of the spring oriented either horizontally or vertically, such that the spring constant in the diptube 130 is generated via a compression spring effect or torsional spring effect. In any embodiment according to the present invention, the diptube 130 should have a spring constant that is great enough such that when the diptube 130 is compressed within the container 120, the bottom edge 138 of the diptube 130 creates and maintains a perimetral seal with the interior bottom surface 124 of the container 120.

As seen in FIGS. 5, 6, 9, and 10, in this embodiment the bottom end 136 of the diptube 130 includes a pair of notches 172*a*,172*b* which are arranged opposite another around the perimeter 137 of the bottom end 136 of the diptube 130. Notch 172*a* forms an opening 174*a* that extends into the interior passageway 182 and notch 172*b* forms an opening 174*b* that extends into the interior passageway 182. Each of the notches 172*a*,172*b* has a height 176 and a two-dimensional linear width 178 (see FIG. 6). In this embodiment, the openings 174*a*,174*b* are rectangular when viewed orthogonally, although in alternate embodiments other shapes are possible for the openings 174*a*,174*b*, including but not limited to semi-circular, square, triangular, or wedge-shaped. Although two notches 172*a*,172*b* are included in the diptube 130 in the present embodiment, any number of notches could be used in alternate embodiments in keeping with the spirit of the present invention. In further alternate embodiments, the notches could be replaced with holes, slots, cutouts, or other perforations having any possible shape.

As discussed above, the inherent mechanical spring effect in the diptube 130 caused by compression of the diptube 130 and the bend 148 forces the bottom edge 138 of the diptube 130 against the interior bottom surface 124 of the container 120, and effectively maintains a seal between the bottom edge 138 and the interior bottom surface 124. With the bottom edge 138 perimetrally sealed to the interior bottom surface 124 of the container 120, headspace pressure can be used in the container 120 (for example via port 115) to force liquids and solid residue through the diptube 130 and out of the container 120 via the notches 172*a*,172*b* to fully drain and dry the container 120 in preparation for chemical refilling.

Figure 8:
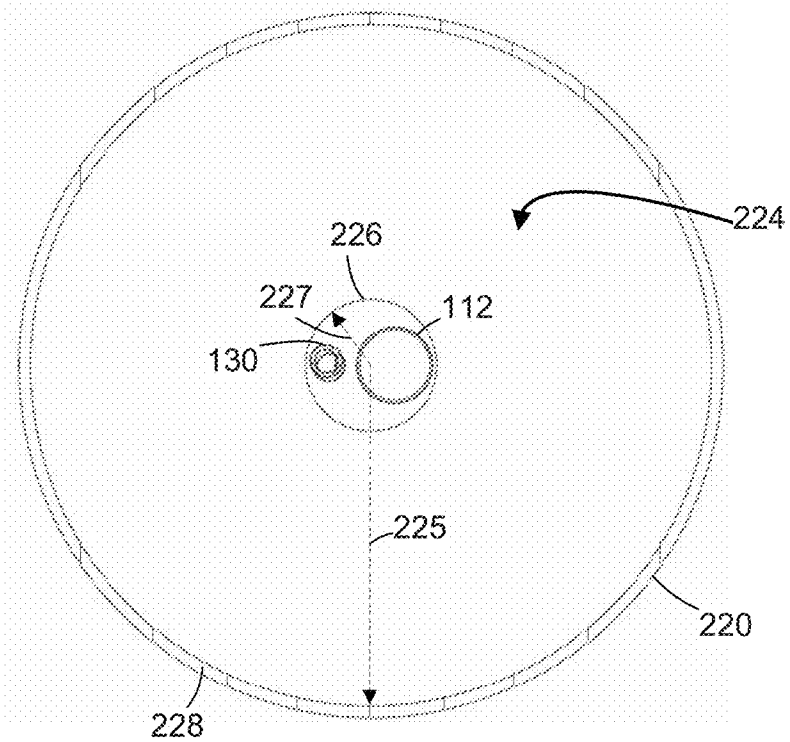
FIG. 8 is a sectional view of a second embodiment of a host ampoule, taken along a line that is equivalent to line 7-7 of FIG. 2.
Figure 7:
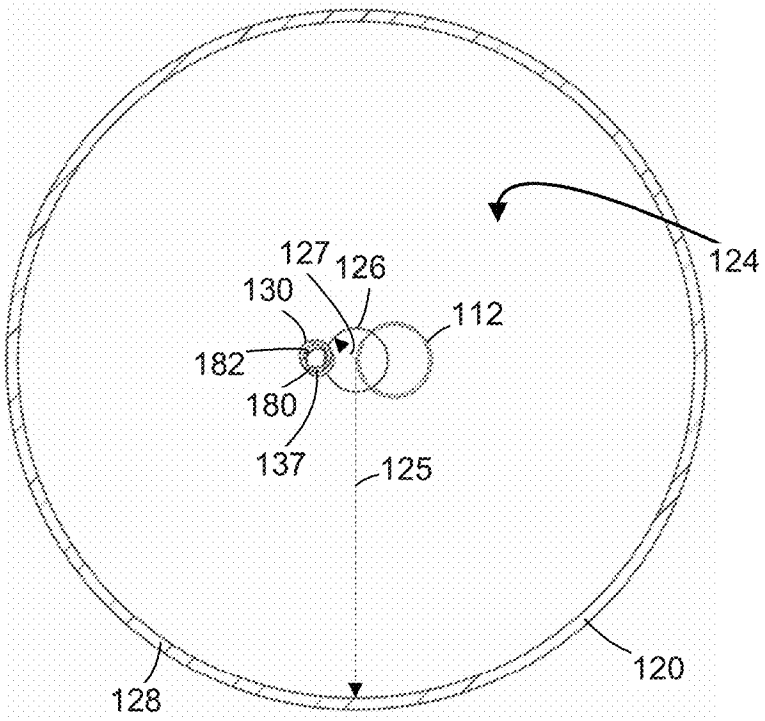
FIG. 7 is a sectional view taken along line 7-7 of FIG. 2.
Figure 10:
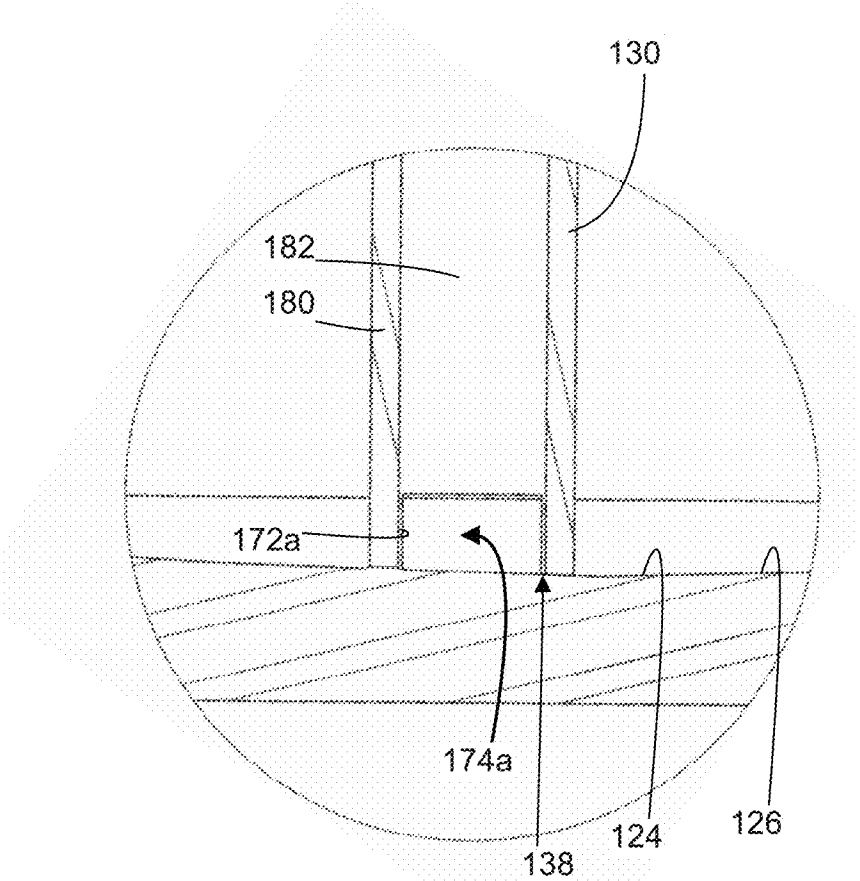
FIG. 10 is a close-up view of the area designated by line 10-10 in FIG. 5.
Figure 9:
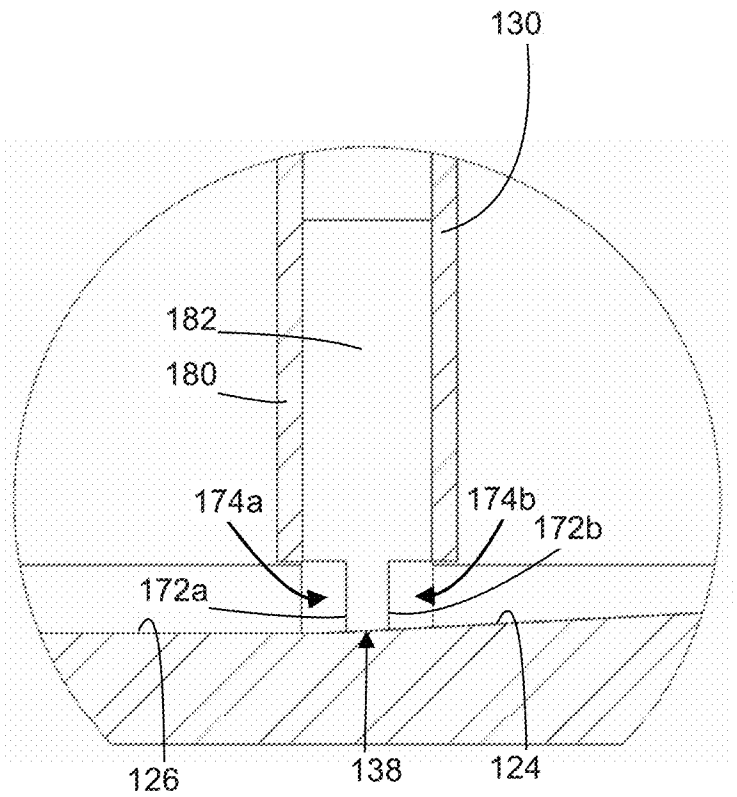
FIG. 9 is a partial sectional view taken along line 9-9 of FIG. 3, showing the bottom end of the diptube.

As shown in FIG. 7, in the present embodiment the planar portion 126 of the interior bottom surface 124 of the container 120 is aligned along the centerline 122 of the container 120, and the bottom ends of the diptube 130 and level sensor probe 112 terminate such that they each partially terminate within the planar portion 126 (rather than come partially into contact with the planar portion 126, the bottom end of the level sensor probe 112 may be located above and at least partially vertically aligned within a perimeter of the planar portion 126). The interior bottom surface 124 has a radius 125 that is measured from the centerline 122 to the inner surface of the outer perimetral wall 128, and the planar portion 126 has a radius 127 that is measured from the centerline 122 to the boundary of the planar portion 126. In this embodiment, the value of the radius 127 of the planar portion 126 is approximately in the range of 5-15% of the value of the radius 125 of the interior bottom surface 124. In an alternate embodiment of the container 220 as shown in FIG. 8, the interior bottom surface 224 has a planar portion 226 of enlarged size such that the bottom ends of the diptube 130 and level sensor probe 112 each fully terminate within the planar portion 226 (rather than come into contact with the planar portion 226, the bottom end of the level sensor probe 112 may be located above and completely vertically aligned within a perimeter of the planar portion 226). The interior bottom surface 224 has a radius 225 that is measured from the centerline of the container 220 to the inner surface of the outer perimetral wall 228 thereof, and the planar portion 226 has a radius 227 that is measured from the centerline of the container 220 to the boundary of the planar portion 226. In the embodiment of FIG. 8, the value of the radius 227 of the planar portion 226 is approximately in the range of 15-25% of the value of the radius 225 of the interior bottom surface 224. In further alternate embodiments, the radius 227 of the planar portion 226 could be equal in value to the radius 225 of the interior bottom surface 224 of the container; in other words, the entire interior bottom surface 224 could comprise the planar portion 226. In still further alternate embodiments, the planar portion 226 may comprise any possible percentage of the area of the interior bottom surface 224 of the container. In alternate embodiments, the planar portion 126 need not be circular and can be any shape with an area that comprises between 0.0001% and 100% of the area defined by 124.

In the herein described embodiment, the perimetral width of the openings 174*a*,174*b* collectively comprise between 25-50% of the value of the perimeter 137 of the bottom end 136 of the diptube 130 (i.e., the openings 174*a*,174*b* collectively extend between 90 and 180 degrees around the perimeter 137 of the bottom end 136). In alternate embodiments, the perimetral width of the openings 174*a*,174*b* may collectively comprise less than 25% or greater than 50% of the value of the perimeter 137 of the bottom end 136 of the diptube 130, for example between 0.1-99.9% of the value of the perimeter 137.

While the principles of the invention have been described above in connection with preferred embodiments, it is to be clearly understood that this description is made only by way of example and not as a limitation of the scope of the invention.

FURTHER ASPECTS OF THE INVENTION

Further aspects of the invention include:

Aspect 1: A container for containing and dispensing a liquid chemical, the container comprising a lid having a lower interior surface and a plurality of ports extending through the lid, a base portion having an interior bottom surface; and a diptube, the diptube comprising an exterior wall defining an interior passageway, a top end that is fixedly attached to a first port of the plurality of ports and extends from the lower interior surface, and a bottom end having a bottom edge, at least a portion of the bottom edge being in contact with the interior bottom surface of the base portion when the lid is affixed to the base, the bottom end further comprising at least one notch that extends to the bottom edge and through the exterior wall into the interior passageway.

Aspect 2: The container according to Aspect 1, the diptube further comprising at least one bend located between the top end and bottom end thereof, wherein the at least one bend generates a spring force that retains the bottom edge at least partially in contact with the interior bottom surface of the base portion.

Aspect 3: The container according to either of Aspect 1 or Aspect 2, wherein a centerline of the top end of the diptube is not collinear with a centerline of the bottom end of the diptube.

Aspect 4: The container according to Aspect 3, wherein the centerline of the top end is substantially parallel with the centerline of the bottom end.

Aspect 5: The container according to any of Aspects 1-4, wherein the entire bottom edge is in contact with the interior bottom surface of the container.

Aspect 6: The container according to any of Aspects 1-5, the bottom end of the diptube further comprising at least one hole that extends through the exterior wall into the interior passageway but does not come into contact with the bottom edge.

Aspect 7: The container according to any of Aspects 1-6, wherein the top end of the diptube has a top edge, and the top edge is substantially parallel with the bottom edge.

Aspect 8: The container according to any of Aspects 1-7, wherein the interior bottom surface of the container has a planar portion, and at least a portion of the bottom edge of the diptube contacts the planar portion.

Aspect 9: The container according to Aspect 8, wherein the planar portion comprises the lowermost portion of the interior bottom surface.

Aspect 10: The container according to Aspect 8, further comprising a level sensor having a top end and a bottom end, the top end being attached to a second port of the plurality of ports, wherein the bottom end is located above and at least partially vertically aligned within a perimeter of the planar portion.

Aspect 11: The container according to any of Aspects 1-10, the diptube further comprising an uncompressed height that is measured between a top edge of the top end and the bottom edge thereof when the diptube is in an uncompressed state and a compressed height that is measured between the top edge and a lowermost portion of the interior bottom surface of the container that is in contact with the bottom edge when the diptube is installed in the container, wherein the uncompressed height is greater than the compressed height.

Aspect 12: A method comprising: (a) fixedly attaching a top end of a diptube to a lid, the diptube comprising a bottom end having a bottom edge, the diptube comprising an exterior wall defining an interior passageway, the lid further comprising a plurality of ports extending therethrough; (b) locating the lid above a base portion having an interior bottom surface such that at least a portion of the bottom edge of the bottom end of the diptube comes into contact with the interior bottom surface; (c) applying force to the lid or the base portion until the lid and base portion are mated together and the diptube is at least partially compressed within the base portion; and (d) fixedly attaching the lid to the base portion while performing step (c).

Aspect 13: The method according to Aspect 12, wherein step (a) further comprises fixedly attaching the top end of the diptube to the lid, wherein the bottom end of the diptube comprises at least one notch that extends to the bottom edge and through the exterior wall into the interior passageway.

Aspect 14: The method according to either of Aspect 12 or Aspect 13, wherein step (a) further comprises fixedly attaching the top end of the diptube to the lid, the diptube having a bend located between the top end and bottom end thereof such that a centerline of the top end is not collinear with a centerline of the bottom end.

Aspect 15: The method according to any of Aspects 12-14, wherein step (a) further comprises fixedly attaching the top end of the diptube to a lower surface of the lid at a location that is not located within a central volume of the container after the lid has been fixedly attached to the base portion in step (d), the central volume being located along a height of the container between the lower surface of the lid and the interior bottom surface, the height being measured along a centerline of the container between a centerpoint of the lower surface of the lid and a centerpoint of the interior bottom surface, the base portion having a radius that is measured orthogonally from the centerline to an interior surface of an outer wall of the container, the central volume having a radius that is measured orthogonally from the centerline, the radius of the central volume having a value that is no greater than 75% of the value of the radius of the base portion.

Aspect 16: A container for containing and dispensing a liquid chemical, the container comprising: a lid having a lower surface and a plurality of ports extending therethrough, a base portion having an interior bottom surface and an outer wall having an interior surface, a height measured along a centerline of the base portion between a centerpoint of the lower surface of the lid and a centerpoint of the interior bottom surface, the base portion having a radius that is measured orthogonally from the centerline to the interior surface of the outer wall, and a central volume that is located along the height between the lower surface of the lid and the interior bottom surface, the central volume having a radius that is measured orthogonally from the centerline, the radius of the central volume having a value that is no greater than 75% of the value of the radius of the base portion; and a diptube, the diptube comprising a top end that is fixedly attached to the lid, the top end being located entirely external to the central volume, and a bottom end that is located at least partially within the central volume, the bottom end having a bottom edge, wherein at least a portion of the bottom edge is in contact with the interior bottom surface.

Aspect 17: The container according to Aspect 16, the bottom end of the diptube further comprising at least one notch that extends to the bottom edge of the diptube and through an exterior wall of the diptube into an interior passageway thereof.

Aspect 18: The container according to either of Aspect 16 or Aspect 17, the diptube further comprising an integral bend located therein between the top end and the bottom end.

Aspect 19: The container according to any of Aspects 16-18, wherein the radius of the central volume has a value that is at least 5% of the value of the radius of the base portion.

Aspect 20: The container according to any of Aspects 16-19, wherein the entire bottom edge is in contact with the interior bottom surface.

The invention claimed is:

1. A container for containing and dispensing a liquid chemical, the container comprising:

a lid having a lower interior surface and a plurality of ports extending through the lid, a base portion having an interior bottom surface; and a diptube, the diptube comprising:

an exterior wall defining an interior passageway, a top end that is fixedly attached to a first port of the plurality of ports and extends from the lower interior surface, and a bottom end having a bottom edge, at least a portion of the bottom edge being in contact with the interior bottom surface of the base portion when the lid is affixed to the base portion, the bottom end further comprising at least one notch that extends to the bottom edge and through the exterior wall into the interior passageway wherein the diptube further comprises an uncompressed height that is measured between a top edge of the top end and the bottom edge thereof when the diptube is in an uncompressed state and a compressed height that is measured between the top edge and a lowermost portion of the interior bottom surface of the container that is in contact with the bottom edge when the diptube is installed in the container, wherein the uncompressed height is greater than the compressed height.

2. The container of claim 1, the diptube further comprising at least one bend located between the top end and bottom end thereof, wherein the at least one bend generates a spring force that retains the bottom edge at least partially in contact with the interior bottom surface of the base portion.

3. The container of claim 1, wherein a centerline of the top end of the diptube is not collinear with a centerline of the bottom end of the diptube.

4. The container of claim 3, wherein the centerline of the top end is substantially parallel with the centerline of the bottom end.

5. The container of claim 1, wherein the entire bottom edge is in contact with the interior bottom surface of the container.

6. The container of claim 1, the bottom end of the diptube further comprising at least one hole that extends through the exterior wall into the interior passageway but does not come into contact with the bottom edge.

7. The container of claim 1, wherein the top end of the diptube has a top edge, and the top edge is substantially parallel with the bottom edge.

8. The container of claim 1, wherein the interior bottom surface of the container has a planar portion, and at least a portion of the bottom edge of the diptube contacts the planar portion.

9. The container of claim 8, wherein the planar portion comprises the lowermost portion of the interior bottom surface.

10. The container of claim 8, further comprising a level sensor having a top end and a bottom end, the top end being attached to a second port of the plurality of ports, wherein the bottom end is located above and at least partially vertically aligned within a perimeter of the planar portion.

11. A method comprising:

(a) fixedly attaching a top end of a diptube to a lid, the diptube comprising a bottom end having a bottom edge, the diptube comprising an exterior wall defining an interior passageway, the lid further comprising a plurality of ports extending therethrough;

(b) locating the lid above a base portion having an interior bottom surface such that at least a portion of the bottom edge of the bottom end of the diptube comes into contact with the interior bottom surface;

(c) applying force to the lid or the base portion until the lid and base portion are mated together and the diptube is at least partially compressed within the base portion; and (d) fixedly attaching the lid to the base portion while performing step (c).

12. The method of claim 11, wherein step (a) further comprises fixedly attaching the top end of the diptube to the lid, wherein the bottom end of the diptube comprises at least one notch that extends to the bottom edge and through the exterior wall into the interior passageway.

13. The method of claim 11, wherein step (a) further comprises fixedly attaching the top end of the diptube to the lid, the diptube having a bend located between the top end and bottom end thereof such that a centerline of the top end is not collinear with a centerline of the bottom end.

14. The method of claim 11, wherein step (a) further comprises fixedly attaching the top end of the diptube to a lower surface of the lid at a location that is not located within a central volume of the container after the lid has been fixedly attached to the base portion in step (d), the central volume being located along a height of the container between the lower surface of the lid and the interior bottom surface, the height being measured along a centerline of the container between a centerpoint of the lower surface of the lid and a centerpoint of the interior bottom surface, the base portion having a radius that is measured orthogonally from the centerline to an interior surface of an outer wall of the container, the central volume having a radius that is measured orthogonally from the centerline, the radius of the central volume having a value that is no greater than 75% of the value of the radius of the base portion.

15. A container for containing and dispensing a liquid chemical, the container comprising:

a lid having a lower surface and a plurality of ports extending therethrough, a base portion having an interior bottom surface and an outer wall having an interior surface, a height measured along a centerline of the base portion between a centerpoint of the lower surface of the lid and a centerpoint of the interior bottom surface, the base portion having a radius that is measured orthogonally from the centerline to the interior surface of the outer wall, and a central volume that is located along the height between the lower surface of the lid and the interior bottom surface, the central volume having a radius that is measured orthogonally from the centerline, the radius of the central volume having a value that is no greater than 75% of the value of the radius of the base portion; and a diptube, the diptube comprising a top end that is fixedly attached to the lid, the top end being located entirely external to the central volume, and a bottom end that is located at least partially within the central volume, the bottom end having a bottom edge, wherein at least a portion of the bottom edge is in contact with the interior bottom surface.

16. The container of claim 15, the bottom end of the diptube further comprising at least one notch that extends to the bottom edge of the diptube and through an exterior wall of the diptube into an interior passageway thereof.

17. The container of claim 15, the diptube further comprising an integral bend located therein between the top end and the bottom end.

18. The container of claim 15, wherein the radius of the central volume has a value that is at least 5% of the value of the radius of the base portion.

19. The container of claim 15, wherein the entire bottom edge is in contact with the interior bottom surface.

* * * * *